US006240716B1

(12) United States Patent
Yanagawase et al.

(10) Patent No.: US 6,240,716 B1
(45) Date of Patent: Jun. 5, 2001

(54) STABLE DOUBLE COVERED ELASTIC YARN, PROCESS FOR MAKING SAME, AND FABRIC COMPRISING SAME

(75) Inventors: Takeshi Yanagawase; Shoichi Hayashi, both of Otsu (JP)

(73) Assignee: DuPont Toray Company, Ltd., Tokyo (JP)

( * ) Notice: Subject to any disclaimer, the term of this patent is extended or adjusted under 35 U.S.C. 154(b) by 0 days.

(21) Appl. No.: 09/355,232

(22) PCT Filed: Jan. 27, 1998

(86) PCT No.: PCT/US98/01667

§ 371 Date: Sep. 1, 1999

§ 102(e) Date: Sep. 1, 1999

(87) PCT Pub. No.: WO98/32904

PCT Pub. Date: Jul. 30, 1998

(30) Foreign Application Priority Data

Jan. 29, 1999 (JP) ..... 9-031268

(51) Int. Cl.[7] ..... D02G 3/32

(52) U.S. Cl. ..... 57/210; 57/2; 57/3; 57/6; 57/10; 57/12; 57/207; 57/225; 57/230; 57/244; 428/370; 428/373; 428/375; 428/377

(58) Field of Search ..... 57/2, 3, 6, 10, 57/12, 207, 210, 225, 230, 244; 428/370, 373, 375, 377

(56) References Cited

U.S. PATENT DOCUMENTS 1,992,448 * 2/1935 Smith ..... 117/57
4,226,076 * 10/1980 Griset, Jr. ..... 57/12

FOREIGN PATENT DOCUMENTS

1435236 * 1/1969 (DE) .
0397500-A2 * 11/1990 (EP) .

* cited by examiner

*Primary Examiner*—John J. Calvert
*Assistant Examiner*—Shaun R. Hurley
(74) *Attorney, Agent, or Firm*—George A. Frank

(57) ABSTRACT

A double-covered yarn based on a spandex core having a heat set of at least 50% and two sheath yarns wound in the same direction, a process for the preparation of such yarn and fabrics produced therefrom, are provided.

8 Claims, No Drawings

STABLE DOUBLE COVERED ELASTIC YARN, PROCESS FOR MAKING SAME, AND FABRIC COMPRISING SAME

BACKGROUND OF THE INVENTION

1. Field of the Invention

The present invention relates to a stable double covered elastomeric yarn, a process for making such a yarn, and fabric comprising such a yarn and, more especially, it relates to a yarn having a coordinated sheath twist orientation.

2. Discussion of the Background Art

Covered elastic yarns, such as single covered yarns obtained by winding an inelastic filament yarn or inelastic staple fiber around a core elastic yarn, and double covered yarns obtained by further winding around the single covered yarn a second inelastic filament yarn or inelastic staple fiber, are used in a variety of apparel applications. Such covered elastic yarns recently have come to be used in stretch woven applications that do not require a great deal of stretchability.

Japanese Published Patent Application No. 06-049736 (1994) discloses the use in elastic woven fabrics of an elastic polyurethane fiber covered with a multifilament yarn in which the weight ratio of the multifilament yarns to the elastic fiber is one to five. That is, the elastic fiber is 50% to about 80% of the weight of the covered yarn. However, the problems of fluff, stability, and hand that arise when the covering fiber is in staple form are not solved in this disclosure.

Further, typical stretch fabrics using conventional elastomeric polyurethane fibers have been deficient in that they have a low wet heat settability and tend to shrink on laundering. The covered yarn can also exhibit its instability in that the core yarn and sheath yarn can shift with respect to each other so that the elastic yarn slips in at cut edges of the fabric and the core yarn penetrates the covering yarn. Such yarns can also result in fluff formation and give fuzzy fabrics, or curl in the case of knit products. In order to enhance hot-wet stability, the heat-set temperature could be increased, but covered elastic yarns using thermally degradable fibers such as wool and acrylic staple as sheath yarns cannot tolerate wet temperatures of 100° C. or higher in dyeing and finishing or dry temperatures of 160° C. or higher because the soft hand can be lost and fabric strength reduced. A stable covered elastic yarn is still needed.

SUMMARY OF THE INVENTION

The double covered elastic yarn of this invention consists essentially of:

a spandex core wherein the spandex has a heat set of at least 50%;

a first sheath yarn wound around the spandex to form a single covered yarn not exceeding 40 percent of the total weight of the double covered yarn; and a second sheath yarn wound around the single covered yarn;

wherein the first and second sheath yarns are wound in the same direction.

The process for making a double covered elastic yarn of this invention comprises the steps of:

providing a spandex having a heat set of at least 50% from a spandex supply package; stretching the spandex in the range of about 100 to 250%;

covering the stretched spandex with a first sheath yarn to form a single covered yarn;

covering the single covered yarn with a second sheath yarn wound in the same direction as the first sheath yarn to form a double covered yarn, wherein the single covered yarn is not more than 40 weight percent of the double covered yarn; and heat setting the double covered yarn.

The woven fabric of this invention comprises the double covered yarn described above as the only warp yarn or as the only weft yarn.

DETAILED DESCRIPTION OF THE INVENTION

As used herein, "spandex" means a manufactured fiber in which the fiber-forming substance is a long chain synthetic elastomer comprised of at least 85% by weight of a segmented polyurethane. Spandex in the range of about 20 to 166 decitex (about 18 to 150 denier) is suitable for use in making the double covered yarn of the present invention.

"Sheath yarn" means a relatively inelastic yarn comprising continuous filaments, bundled staple fibers, or spun staple fibers, or both filaments and staple fibers. The "first sheath yarn" is the sheath yarn wound around the spandex to form a single covered yarn. The "second sheath yarn" is the sheath yarn wound around the single covered yarn to form a double covered yarn.

Suitable filament sheath yarns include polyester, nylon, acrylic, rayon, acetate, silk, and the like. Suitable staple fibers include synthetic fibers such as polyester, nylon, acrylic, rayon, and acetate, and natural fibers such as cotton, wool, and the like, or blends thereof. Continuous filaments, for example nylon filament, are preferred as the first sheath yarn. Wool and staple acrylic fibers are preferred as the second sheath yarn.

"Heat set" means that a spandex, after being stretched to 100% elongation, is heat treated while in the elongated condition, and released from the elongation, returns to a length which is longer than the original length. Thus, for example, if a 10-cm length spandex returns to a 15-cm length after being stretched to 20 cm, exposed to elevated temperatures, and released, it is said to have 50% heat set.

"Fluff" means loose ends of staple fibers extending from the double covered yarn, resulting in an undesirably fuzzy yarn that is difficult to knit or weave.

To obtain the stable double covered yarn of the present invention, the yarn is made with a coordinated twist orientation of the first and second sheath yarns. The spandex core fiber has at least 50% set and preferably at least 55% set, as can be determined by water immersion heat treatment at 100° C. for 60 minutes at 100% elongation. In applications where the double covered yarn of this invention is to be set with dry heat, the spandex has at least a 50% set and preferably at least 55% set after dry heat treatment at 140° C. for 1 minute when elongated to 100% elongation.

In the stable double covered yarn of the present invention, the first and second sheath yarns are wound in the same direction, either both in the z-direction or both in the s-direction. Under such circumstances, the yarn bulkiness (distention) is small, and the covering will tighten while interlacing the fluffs. In turn, this results in fluff binding and in a reduction of the number of excessively long fluffs. Since size is not generally applied to a woven fabric made with a single wool yarn as the warp, weaving would be difficult unless the fluffs can be bound to the yarn. Because fluffs are bound in the yarn of this invention, it can be used without sizing as the only warp yarn in a woven. The is particularly useful for light weight stretch wovens for spring and summer wear, in which case, however, the single covered yarn preferably has a relatively high metric count such as 1/40

("singles forty"). The double covered yarn of the present invention can also be used satisfactorily as the only yarn in the weft or in both warp and weft.

In contrast, when the twist directions of the two sheath yarns are different, the twists in the first sheath yarn can be de-twisted during covering with the second sheath yarn to give a bulky final yarn and increased fluffs, particularly excessively long fluffs. In addition, different twist directions can result in partial exposure on the yarn surface of the first sheath yarn.

The double covered yarn of the present invention contains not more than 40 weight percent of the single covered yarn. It is preferred that the single covered yarn be present not exceeding 30 weight percent of the double covered yarn and, more preferably, 25 weight percent. If the single covered yarn exceeds the above limitations when compared to the double covered yarn, the first sheath yarn can appear on the yarn surface or fabric surface, and the fabric then has the hand of the first sheath yarn. In addition, for example, if the second sheath yarn is wool, the number of wool fibers is reduced in the final cover, which worsens the interlacing of the wool and can cause many excessively long fluffs, which makes it difficult to use such a product, especially as the only yarn in the warp or weft.

In the yarn of the present invention, the spandex can comprise in the range of about 2–9 percent by weight of the double covered yarn and preferably in the range of about 2–5 weight percent.

The double covered yarn of the present invention can be heat set in package form or after it has been knit or woven into fabric.

In the process of the present invention, a spandex having at least 50% set and preferably at least 55% set, as can be determined at 100% elongation by water immersion at 100° C. for 60 minutes or dry heat treatment at 140° C. for 1 minute, is taken from its supply package and stretched in the range of about 100 to 250%. The stretched spandex is covered with a first sheath yarn at about 300 to 800 turns per meter to form a single covered yarn.

The single covered yarn is then covered with a second sheath yarn wound in the same direction as the first sheath yarn to form a double covered yarn which comprises not more than 40 weight percent single covered yarn. The twist coefficient of the second sheath yarn can be in the range of about 80–130, preferably about 90–130, turns per meter/(metric count). The single covered yarn preferably comprises not more than 30 weight percent of the double covered yarn and more preferably not more than 25 weight percent.

The double covered yarn can then be heat set either in package form or knit or woven into a fabric and heat set in the fabric. Because the spandex cannot retract below the elongation at which it is covered, it is heat set in an elongated state in the double covered yarn. Heat setting can be either with wet heat (steam or water) at 80° C. or higher or with dry heat at 110° C. or higher. Lower temperatures can be used if lower set can be tolerated, but it is preferred that the set be at least 50%. However, it is preferred that the heat set temperature be somewhat higher (but for example not more than about 20° higher) than the temperature at which the maximum heat shrinkage stress is exhibited by the spandex. Heat setting at temperatures lower than that at which the maximum heat shrinkage stress is exhibited will result in a yarn which will shrink if it later experiences temperatures higher than the heat set temperature. The preferred spandex used in the yarn of the present invention has a maximum heat shrinkage stress in the dry heat temperature range of about 110 to 150° C.

The present invention is further described by the following examples which are not intended to limit the scope of the present invention, which scope is defined by the appended claims.

TESTS

Heat shrinkage stress of the spandex was measured using a "Heat Stress Measurement Instrument KE-2S" (manufactured by Kanebo KK, Japan) by heating with dry heat starting from 27–28° C. under zero tension. The measurements were made on bundles of 10 strands of spandex.

The metric count (km/kg) of the covered elastic yarn was calculated from the weight in grams per 100 m of yarn whose length was measured out with a 1-m circumference lap reel at a tension of 20 g per strand.

The number of fluffs was measured by counting the fluffs in a 10 meter length of double covered yarn.

The weaving capability of the yarns in the Examples was evaluated using a Sulzer Ruti (Winterthur, Switzerland) projectile loom operated at 400 rpm to give a plain woven product.

EXAMPLES

In all Examples, the first sheath yarn was a nylon false twisted continuous filament yarn, and the second sheath yarn was wound in the Z-direction. After the second sheath yarn was applied, the double covered yarn was wound up on a bobbin and steam-set on the bobbin at 85° C. for 30 minutes.

In all Examples, the unfinished fabrics were processed by washing in 40° C. water, drying at 120° C. for 1 minute on a tenter frame, dyeing at 95° C. for 45 minutes in a counter-flow dyeing machine, drying at 120° C. for 1 minute on a tenter frame, and finishing at 100° C. for 45 minutes in a decatizer.

In the Tables, samples representative of the covered yarn of this invention are labeled with Arabic numerals, and comparison samples not of this invention are labeled with capital letters.

Examples 1 and 2

In Examples 1 and 2, the spandex was 20 decitex (18 denier) Opelon® T-178C (registered trademark for a polyurethane elastic yarn manufactured by Toray-DuPont Company, Tokyo, Japan) having an elongation-at-break of 410% and a tenacity-at-break of 1.19 dN/tex (1.35 g/d). The set was 62% after 60 minutes at 100° C. in water and 56% after 1 minute at 140° C. under dry conditions. The maximum heat shrinkage stress temperature was in the range of about 120 to 140° C., and the maximum heat shrinkage stress was 2.28 g for 10 strands of spandex.

During covering with the first sheath yarn, in the z-direction, the spandex was drafted 2.7× (170% stretch). The second sheath yarn was 1/40 metric count wool, applied at 569 turns/meter and a twist coefficient of 90.

Fabrics were woven with the double covered yarns of Examples 1 and 2 as the only yarn in the warp. The weft was 1/40 wool, the warp density was 28 strands/cm (72 strands/inch), and the weft density was 25 picks/cm (64 picks/inch).

Example 3

The spandex used in this example was 28 decitex (25 denier) T-178C Opelon®. During covering with the first sheath yarn, in the z-direction, the spandex was drafted 2.8× (180%). The second sheath yarn was 1/32 acrylic staple, applied at 522 turns/meter and a twist coefficient of 92.

A fabric was woven with the yarn as the only yarn in the warp. The weft was 1/32 metric count acrylic staple, the warp density was 25 strands/cm (64 strands/inch), and the weft density was 22 picks/cm (57 picks/inch).

Comparison Example A

The double covered yarn of this example was prepared as in Example 2, but the first sheath yarn was applied in the s-direction so that the first and second sheath yarns had opposite twist.

Comparison Example B

The spandex used in this example was 22 decitex (20 denier) T-127C Opelon®, having an elongation-at-break of 560% and a tenacity-at-break of 1.06 dN/tex (1.20 g/d). The set of this spandex was a low 21% after 60 minutes at 100° C. in water and 28% after 1 minute at 140° C. under dry conditions, outside of this invention. The maximum heat shrinkage stress temperature was in the range of about 170 to 180° C., and the maximum heat shrinkage stress was 2.28 g for 10 strands of spandex. During covering with the first sheath yarn, the spandex was drafted 2.8× (180%). The second sheath yarn was 1/40 wool, applied at 569 turns/meter and a twist coefficient of 90.

A fabric was woven with the double covered elastic yarn as the only yarn in the warp. The weft was 1/40 metric count wool, the warp density was 28 strands/cm (72 strands/inch), and the weft density was 25 picks/cm (64 picks/inch).

Comparison Example C

The spandex used in this example was 22 decitex (20 denier) T-152C Opelon®, having an elongation-at-break of 510% and a tenacity-at-break of 0.97 dN/tex (1.10 g/d). The set of this spandex was a low 33% after 60 minutes at 100° C. in water and 34% after 1 minute at 140° C. under dry conditions, outside of this invention, the maximum heat shrinkage stress temperature was in the range of about 160 to 170° C., and the maximum heat shrinkage stress was 2.89 g for 10 strands of spandex. During covering with the first heath yarn, the spandex was drafted 2.8× (180%). The second sheath yarn was 1/40 wool, applied at 569 turns/meter and a twist coefficient of 90.

A fabric was woven with the double covered elastic yarn as the only yarn in the warp. The weft was 1/40 metric count wool, the warp density was 28 strands/cm (72 strands/inch), and the weft density was 25 picks/cm (64 picks/inch).

Table 1 shows additional characteristics of the composition and construction of the yarns of this invention (Examples 1, 2, and 3) and comparison yarns (Examples A, B. anc C).

TABLE 1

| | EXAMPLE | | | | | |
|---|---|---|---|---|---|---|
| | 1 | 2 | 3 | A | B | C |
| First sheath yarn | | | | | | |
| decitex | 33 | 78 | 33 | 78 | 33 | 33 |
| filaments | 6 | 24 | 6 | 24 | 6 | 6 |
| turns/meter | 700 | 400 | 700 | 400 | 700 | 700 |
| twist direction | Z | Z | Z | S | Z | Z |
| Single covered yarn as weight % of double covered yarn | 17.0 | 34.6 | 13.6 | 34.6 | 16.5 | 16.5 |

The fabrics were finished and given weaving capability ratings of X for 10 or more yarn breakages per roll of fabric 40 meters long and 0.5 meter wide, Δ for 4–9 yarn breakages per roll, and OO for equal to or less than 3 breakages per roll. The dimensional stability of the woven fabrics was given a rating of OO if the shrinkage on dry cleaning did not exceed 4%. Table 2 shows the weave capability of the yarns, the dimensional stability of the woven product, and the number of yarn fluffs of various lengths per 10 meters of double covered yarn.

TABLE 2

| | EXAMPLE | | | | | |
|---|---|---|---|---|---|---|
| | 1 | 2 | 3 | A | B | C |
| Number of fluffs | | | | | | |
| ≧2 mm, <4 mm | 231 | 437 | 261 | 428 | 220 | 240 |
| ≧4 mm, <7 mm | 54 | 129 | 61 | 148 | 65 | 50 |
| 7 mm and over | 4 | 18 | 10 | 27 | 8 | 6 |
| Weaving capability | OO | Δ | OO | Δ | OO | OO |
| Fabric dimensional stability | OO | OO | OO | OO | X | X |

The data in the Tables show that a stable double covered yarn and stable fabrics made from such yarn can be achieved with a combination of spandex having the required high % heat settability and a low weight percent of single covered yarn in the double covered yarn, wherein the first and second sheath yarns are applied in the same direction.

A comparison of the yarn and fabric of this invention (Examples 1–3) with those of the Comparative Examples outside this invention in Tables 1 and 2 indicates that the dimensional stability of fabrics made with the yarns of Examples 1–3 was superior to that of the fabrics made with yarns outside this invention and the fabric of Comparison Example A showed excessive number of medium to long fluff.

A comparison of Example 2 with Example A indicates that when the twist direction was the same in the first and second sheath yarns, a smaller number of excessively long fluffs and fluff binding resulted. In addition, the nylon first sheath yarn was partially exposed on the yarn surface in Example A, which began to exhibit the hand of nylon.

Example 3 illustrates that a superior double covered yarn was also made when the second sheath yarn was acrylic staple.

What is claimed is:

1. A double covered elastic yarn consisting essentially of:

a spandex core wherein the spandex has a heat set of at least 50%;

a first sheath yarn wound around the spandex to form a single covered yarn not exceeding 40 percent of the total weight of the double covered yarn; and a second sheath yarn wound around the single covered yarn;

wherein the first and second sheath yarns are wound in the same direction.

2. The yarn of claim 1 wherein the spandex is in the range of about 2–9 weight percent of the total weight of the double covered yarn and the second sheath yarn is wound at a twist coefficient in the range of about 80–130.

3. The yarn of claim 2 wherein the single covered yarn amounts to at most about 30 weight percent of the total weight of the double covered yarn, the first sheath yarn is nylon continuous filament, and the second sheath yarn is wool or acrylic staple.

4. The yarn of claim 3 wherein the spandex amounts to in the range of about 2 to 5 weight percent of the total weight of the double covered yarn.

5. A process for making a double covered elastic yarn comprising the steps of:

providing a spandex having a heat set of at least 50% from a spandex supply package;

stretching the spandex in the range of about 100 to 250%;

covering the stretched spandex with a first sheath yarn to form a single covered yarn;

covering the single covered yarn with a second sheath yarn wound in the same direction as the first sheath yarn to form a double covered yarn, wherein the single covered yarn is not more than 40 weight percent of the double covered yarn; and heat setting the double covered yarn.

6. The process of claim 5 wherein the double covered yarn is heat set under wet conditions at a temperature of at least about 80° C.

7. The process of claim 5 wherein the double covered yarn is heat set under dry conditions at a temperature of at least about 110° C.

8. The process of claim 5 wherein the single covered yarn is not more than 30 weight percent of the double covered yarn, the first sheath yarn is nylon continuous filament and the second sheath yarn is wool or acrylic staple.

* * * * *